US005487316A

United States Patent [19]

Hornung et al.

[11] Patent Number: 5,487,316

[45] Date of Patent: Jan. 30, 1996

[54] IMPROVED CONTROL SELECTOR MECHANISM

[75] Inventors: Richard E. Hornung, Fisherville; Patrick C. Luken, Simpsonville, both of Ky.

[73] Assignee: General Electric Company, Louisville, Ky.

[21] Appl. No.: 439,464

[22] Filed: May 11, 1995

Related U.S. Application Data

[63] Continuation of Ser. No. 136,314, Oct. 13, 1993, abandoned.

[51] Int. Cl.[6] ..... G05G 1/10; G05G 5/06

[52] U.S. Cl. ..... 74/527; 74/553; 74/565; 126/42; 200/565

[58] Field of Search ..... 74/10.41, 526, 74/527, 553; 126/39 BA, 39 N, 39 R, 42, 52; 200/291, 336, 565, 567

[56] References Cited

U.S. PATENT DOCUMENTS

| | | | |
|---|---|---|---|
| 2,115,284 | 4/1938 | Pratt | 74/527 |
| 3,226,999 | 1/1966 | Allison | 74/10.41 |
| 4,038,508 | 6/1977 | Mapelsden | 200/336 |

*Primary Examiner*—Rodney H. Bonck
*Assistant Examiner*—Troy Grabow
*Attorney, Agent, or Firm*—H. Neil Houser

[57] ABSTRACT

A control includes a shaft rotatable between a plurality of positions. The base of a spring is fixed relative to the shaft and arms extend from the base parallel to the shaft. Each arm includes a resilient finger and a nose projects from each finger toward the shaft. The noses are 180 angular degrees apart and at different positions longitudinally of the shaft. A cam rotates with the shaft and the noses are biased against the outer surface of the cam. A plurality of recesses are angularly spaced apart around the outer surface of the cam in pairs which are spaced 180 angular degrees apart. One of each pair of recesses is longitudinally aligned with one nose and the other of that pair is longitudinally aligned with the other nose. The noses and recesses provide a detent when the recesses of a pair are angularly aligned with the noses with which they are longitudinally aligned and do not form a detent when the shaft is substantially 180 angular degrees removed therefrom. An additional pair of recesses are spaced 180 angular degrees apart and are elongated to longitudinally align with both noses. The additional pair of recesses are angularly aligned with the noses to facilitate mounting the cam on or removing the cam from the shaft.

9 Claims, 2 Drawing Sheets

IMPROVED CONTROL SELECTOR MECHANISM

This application is a continuation of application Ser. No. 08/136,314, filed Oct. 13, 1993, and now abandoned.

BACKGROUND OF THE INVENTION

Numerous control mechanisms have operating or adjustment shafts which are rotatable between various positions to provide desired settings. Some such control mechanisms change the electrical connection between various individual contacts. Others alter the setting of a variable resistor, such as U.S. Pat. No. 3,997,864 or 5,150,095 for example, each of which is included herein by reference.

Typical of such control mechanisms are the controls for electric ovens. They provide a range of temperatures for normal cooking (baking), such as from "warm" to about 550 degrees Fahrenheit, as well as a broil setting, an automatic clean setting and an off setting. With such controls it is desirable that there be a detent or positive stop at each end of the normal range, as well as at the broil, the automatic clean and the off settings. On the other hand it is desirable that the normal or bake cooking range not include any detents.

The detent or stop action needs to be distinct to assure the user that the control is at the desired setting. At the same time the operating knob and indication dial need to be small to fit on the backsplash (control panel) of an oven. In addition modern controls are becoming more and more compact, which means that it is more and more important that the force used to generate the detents be applied to the operating shaft in a balanced manner.

An object of this invention is to provide an improved control mechanism in which the detent generating force is applied in a balanced manner.

Another object of this invention is to provide such a control mechanism in which a significant amount of detent force is generated in a confined area.

Yet another object of this invention is to provide such a control mechanism which is easily assembled and disassembled.

SUMMARY OF THE INVENTION

In accordance with one form of the present invention a control comprises an elongated shaft rotatable between a plurality of positions. A spring member has a stationary base positioned perpendicular to the shaft and a pair of spaced apart arms extending generally parallel to and on opposite sides of the shaft. Each of the arms is pivotal at its junction with the base. Each arm includes a resilient finger extending perpendicular to the shaft and a projection extends from each finger toward the shaft. The projections are substantially 180 angular degrees apart and at different positions longitudinally of the shaft.

A cam is mounted for rotation with the shaft and includes an outer surface received between the spring projections, with the spring arms biasing the projections into contact with the cam outer surface. A plurality of recesses are angularly spaced apart about the cam outer surface and are arranged in pairs positioned substantially 180 angular degrees apart. One recess of each pair is longitudinally aligned with one of the spring projections while the other recess of each pair is longitudinally aligned with the other spring projection so that a detent is provided at the angular position of the shaft at which each of the pair of recesses is angularly aligned with the projection with which it also is longitudinally aligned and no detent is provided at the shaft position 180 angular degrees removed therefrom.

An additional pair of recesses are provided in the cam outer surface, positioned substantially 180 angular degrees apart and extending longitudinally sufficiently to be aligned with both spring projections so that mounting the cam on or removing the cam from the shaft is facilitated by aligning the additional pair of recesses with the projections.

DETAILED DESCRIPTION OF PREFERRED EMBODIMENT

Figure 1:
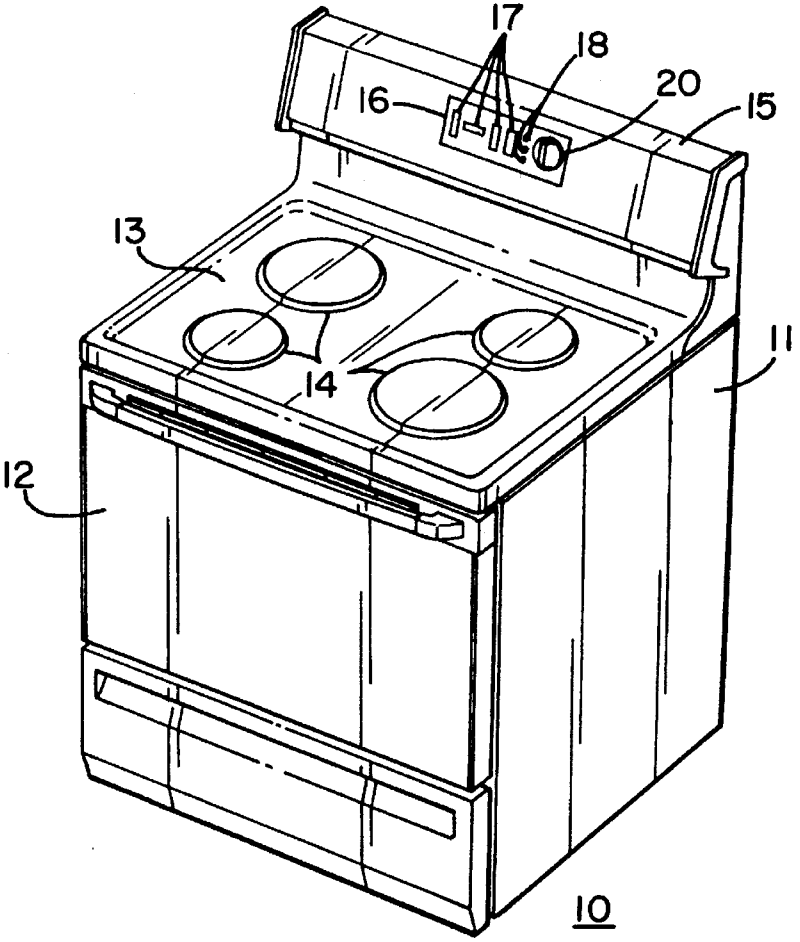
FIG. 1 is a perspective view of a free standing electric range with which controls incorporating the present invention are useful.

Referring now to FIG. 1, there is shown a free standing electric range 10. A typical range includes a housing 11 enclosing an oven (not shown) which is accessed by door 12. The upper surface or panel 13 supports a number of surface heating units 14. A backsplash 15 includes a control panel 16 that houses various user interface devices such as controls 17, indicator lights 18 and a rotary oven control 20.

Figure 4:
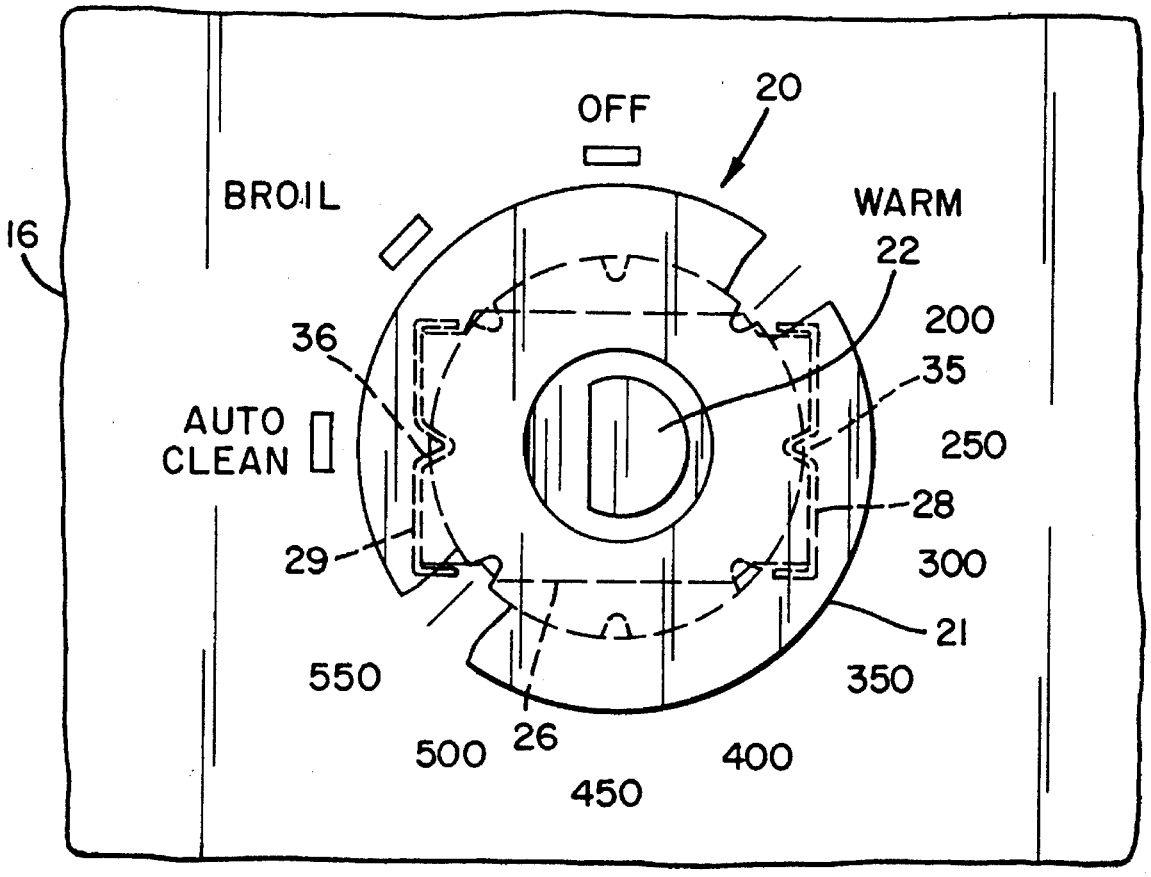
FIG. 4 is a fragmentary plan view of the control panel of the range of FIG. 1, illustrating a control mechanism incorporating one form of the present invention, with the view being partly broken away and with some components removed for illustration.

Oven control 20 is exemplary of controls or switches that are operated by rotating the control knob. Some such controls have multiple switch positions while others can be various forms of variable resistors. As with oven controls, it is often desirable to provide a detent or positive stop action at certain switch positions while having no detent at other positions. Referring now particularly to FIG. 4, there is illustrated a portion of the control panel 16, rotary control 20 and indicator ring 21 that show the various positions or settings of the control 20. It will be seen that the control 20 may be set to OFF, at which the heating elements of the oven are not energized; to a range of temperatures between WARM and 550 degrees Fahrenheit, with selected represented temperatures throughout the range indicated by the numerals 200, 250, 300, 350, 400, 450, and 500; to the AUTO CLEAN setting, at which the oven is set to perform a self-cleaning operation; and to a BROIL setting, at which the oven will broil food using only its upper heating element. All these operations are shown for illustrative purposes and will not be described in greater detail as they are well known to those skilled in the art. It is desirable to have a detent or positive stop at each of the WARM, 550, AUTO CLEAN, BROIL and OFF positions, both to assure that the control is correctly set at the desired position and to provide the user with assurance of that fact, On the other hand, in modern day continuously adjustable temperature controls for example, it is desirable not to have any detents between the WARM and the 550 degrees settings.

Referring now more particularly to FIGS. 2–5, there is illustrated a rotary control 20, and more particularly the rotary operating mechanism of such a control incorporating one embodiment of the present invention. The control includes a shaft 22 which is rotated by the user to change the setting of the control mechanism. The terminal portion of the shaft 22 is "D" shaped so the control knob 24 and similar parts may be mounted on the shaft to rotate with it. It will be understood that the details of a particular control mechanism are not part of the present invention and are not described as many such mechanisms are well known in the art.

Figure 5:
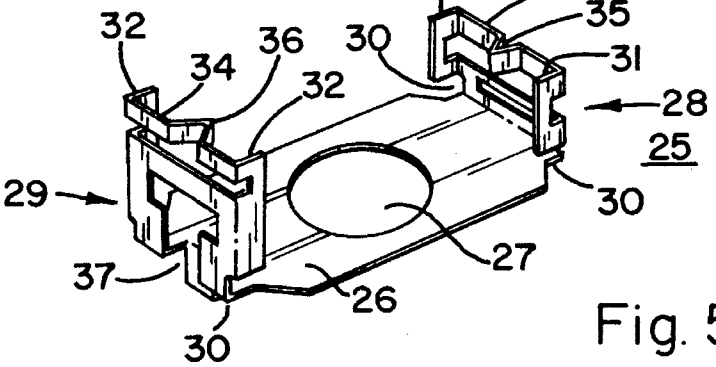
FIG. 5 is a perspective view of the spring of a control operating mechanism incorporating one form of the present invention.

Referring particularly to FIG. 5, a spring 25 includes an elongated base 26 with a central opening or aperture 27 large enough to fit around shaft 22 with ample clearance. Each end of the base 26 is bent upwardly at a substantially right angle to form arms 28 and 29 respectively. The spring, in the areas of the junctions between base 26 and arms 28, 29, has a reduced width as indicated at 30. At the same time the lateral edge portions 31 and 32 of the arms 28, 29 respectively are bent at substantially right angles to the main portions of the arms. This assures that the arms will pivot or rotate about their junctions with the base while the arms themselves will not flex. Flexible fingers 33, 34 are lanced from the upper portions of the arms 28, 29 to extend across the arms. The fingers include centrally positioned noses or projections 35, 36 respectively which extend inwardly of the arms. It will be noted that each of the fingers 33, 34, and thus each of the noses 35, 36 is at a different height or distance from the base 26 than the other arm and nose. The finger 29 is cut away at 37 so that, when the arms are forced or rotated outward about the junctions 30, each arm will exert substantially the same force through the noses 35, 36, even though arm 29 is longer than arm 28.

Figure 3:
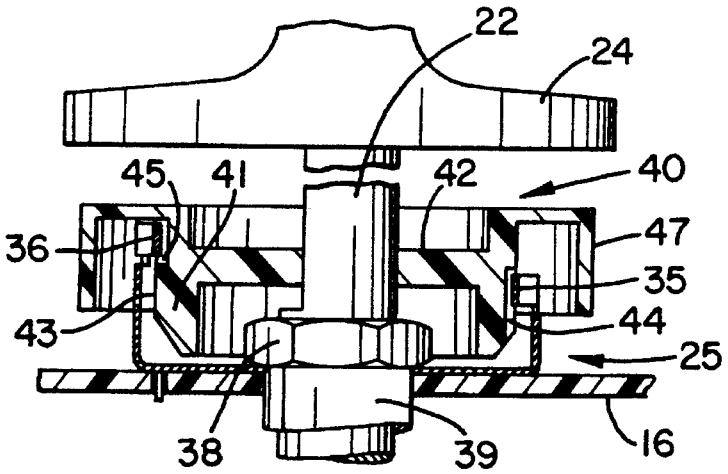
FIG. 3 is a side elevational view, partly in section, of a control as shown in FIG. 2.

Referring particularly to FIG. 3, it will be seen that the spring 25 is positioned with its base 26 against control panel 16 and with shaft 22 projecting through the central opening 27 and is secured against movement by a nut 38 that is threaded on a collar 39 around the shaft 22. The arms 28, 29 extend outwardly of the control panel on substantially opposite sides of and parallel to the shaft 22. In this manner the noses 35, 36 are substantially 180 angular degrees apart around the shaft, are at different positions longitudinally of the shaft and face or extend toward the shaft.

Figure 2:
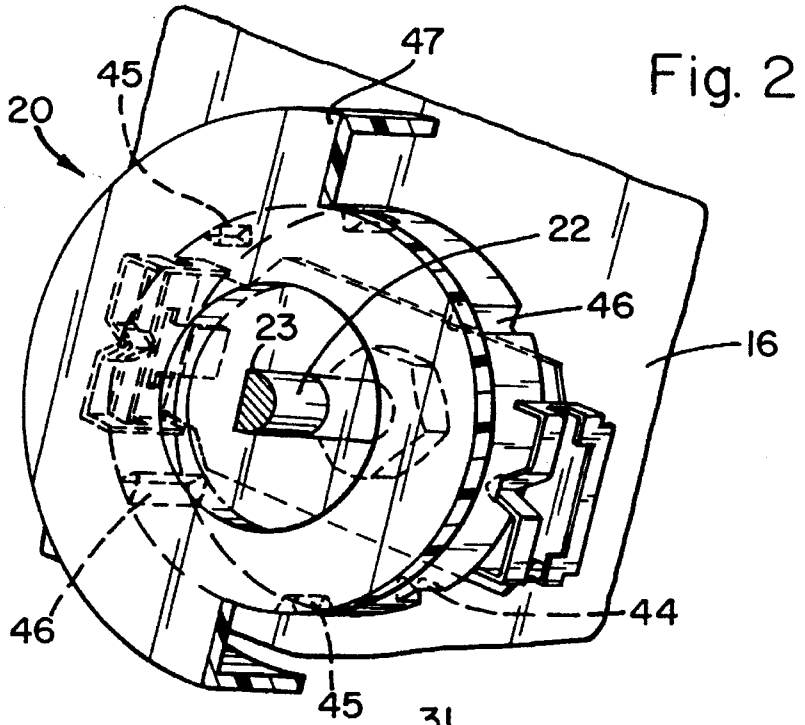
FIG. 2 is a perspective view of the operating mechanism of a control incorporating the present invention, with the view being partly broken away and with some parts removed for purposes of illustration.

Referring particularly to FIGS. 2 and 3, a cam member 40 includes a cylindrical body portion 41 and a central web 42. The central web includes a D shaped opening (not shown) which fits closely about the D shaped portion 23 of the shaft 22 so that the cam member is mounted on the shaft for rotation therewith with the cylindrical body 41 positioned between the arms 28, 29 of the spring 26. The cylindrical body includes an outer surface 43 which is engaged by the noses 35, 36 of resilient fingers 33, 34 and the diameter of the surface 43 is sufficiently large that the noses are forced apart. This outward movement of the noses is accommodated by a combination of flexing of the fingers and rotation of the arms 28, 29 about their junctions with the spring base 26.

Each nose is aligned with a different longitudinal portion of the cam outer surface 43. As best seen in FIG. 3, nose 35 is aligned with a portion of surface 42 relatively close to control panel 16 while nose 36 is aligned with a portion of surface 42 further away from control panel 16. In order to provide detents at all but two of the desired locations several recesses are provided in the outer surface 42. These recesses are provided in pairs with one recess 44 of each pair longitudinally aligned with nose 35 and the other recess 45 of each pair longitudinally aligned with nose 36. In addition each recess of a pair of recesses is positioned 180 arcuate degrees around the cam outer surface 43 from the other recess of that pair. As the knob 24 rotates shaft 22 and thus cam member 40 the noses 35, 36 ride against the cam surface 43. When nose 35 comes into arcuate register with one of the recesses 44 (with which it is longitudinally aligned), nose 36 will come into arcuate register with the recess 45 of that pair of recesses (with which it also is longitudinally aligned). The spring then will force the noses or protrusions 35, 36 into the recesses 44, 45. This provides a detent or stop for the cam member 40 and thus the shaft 22 and the control 20. In this regard the recesses conveniently may be of such depth that the spring arms are in their rest position parallel to shaft 22 when the noses 35, 36 are fully seated in the recesses 44, 45. When the cam member is 180 angular degrees away from that position, the nose 35 is arcuately aligned but not longitudinally aligned with that recess 45, while the nose 36 is arcuately aligned but not longitudinally aligned with the other recess 44 of that pair of recesses. Therefore, no detent or stop is provided. In summary, while the noses and the pairs of recesses are spaced 180 arcuate degrees apart around the cam member, the noses and the recesses of each pair of recesses will come into register at only one position in the entire circumference of the cam member. Referring particularly to FIG. 4, the illustrative control provides the pairs of recesses at predetermined positions around the cam member to provide a detent or stop at the OFF, AUTO CLEAN and BROIL positions.

It will be recognized that none of the recesses in these pairs of recesses is both arcuately aligned with a recesses 45 and longitudinally aligned with a recesses 44. If these were the only recesses it would be difficult to assemble the cam member 40 on shaft 22 without damage to the cam outer surface 43 and perhaps to the spring member 26. In order to provide for easy mounting and to provide the last two desired detents, an additional pair of detents 46 are provided and are spaced 180 angular degrees apart around the cam surface 43. Each of the additional detents 46 is sufficiently long to longitudinally register with both of noses 35, 36 and preferably extends to the distal end of surface 43, which is inserted first over the shaft 22. The additional detents 46 are 180 degrees apart and the WARM and 550 degree positions of the control 20 are placed 180 degrees apart. Thus a detent or stop is provided when noses 35, 36 come into arcuate alignment with each of the recesses 46. However, this is acceptable as the WARM and 550 degree positions are 180 degrees apart.

The cam member 40 is mounted on shaft 22 by aligning the D shaped opening in web 42 with the D shaped portion of shaft 22; turning these members until the recesses 46 arcuately align with noses 35, 36 and then pushing the cam member axially on the shaft. The cam member 40 includes an outer skirt 47 which is outside and parallel to the outer surface 43. The skirt extends around the spring arms 28, 29 when the cam is seated on the shaft 22. This protects the spring arms and provides a servicer with a means of grasping the cam member for inserting it on and removing it from the shaft 22.

With the current invention detents are provide at the desired locations with a minimum number of spring projections and recesses while, at the same time, the forces exerted on the cam member are balanced as the spring arms 28, 29 exert substantially equal and opposite forces on outer surface 43. The combination of the rotation or bending of arms 28, 29 about their junctions with spring base 26 and the flexing of fingers 33, 34 enable the spring to exert sufficient force on cam member 30 through the noses 35, 36 to provide solid detents or stops in a very small and confined space.

What is claimed is:

1. In a control having an elongated adjustment shaft rotatable between a multitude of positions, the combination comprising:

a spring member including first and second flexible arms extending generally axially of said shaft on opposite sides of said shaft; each of said arms including a nose at a different position longitudinally of said shaft than the nose of said other arm engages said shaft;

a cam mounted for rotation with said shaft and including a generally cylindrical outer surface positioned between and overlapping said noses so that said noses are spring biased into engagement with said outer surface of said cam; and a plurality of recesses angularly spaced apart about said outer surface of said cam; said plurality of recesses being arranged in pairs positioned on substantially opposite angular sides of said cam outer surface; one of each pair of recesses being longitudinally aligned with one of said noses and the other of each pair of recesses being longitudinally aligned with the other of said noses; and said cam outer surface having no recess angularly opposite and longitudinally aligned with each of said recesses;

whereby a detent is provided at each angular position of said shaft in which each recess of a pair of recesses is angularly aligned with the nose with which that recess also is longitudinally aligned and no detent is provided at the angular position of said shaft substantially one hundred and eighty degrees removed therefrom.

2. The combination set forth in claim 1 wherein: an additional pair of recesses are provided in said outer surface of said cam, are positioned on substantially opposite angular sides of said cam and each of said additional pair of recesses extends longitudinally of said shaft sufficiently to be longitudinally aligned with both of said noses so that said cam may be easily mounted on or removed from said shaft by aligning said additional pair of recesses with said pair of noses.

3. The combination as set forth in claim 1, further comprising: an operating knob mounted for rotation with said shaft to move said shaft between the multiplicity of its positions.

4. The combination set forth in claim 1, wherein: said arms exert substantially balanced forces on said cam outer surface when said shaft is rotated between its multiplicity of positions.

5. A control comprising:

an elongated adjustment shaft rotatable between a plurality of positions;

a spring member having a stationary base positioned perpendicular to the axis of said shaft and a pair of spaced apart arms projecting from said base, extending generally parallel to the axis of said shaft on opposite sides of said shaft; each of said arms having a degree of pivotal movement at its junction with said base; each of said arms including a projection extending toward said shaft, said projections being positioned substantially 180 angular degrees apart around said shaft and each of said projections being at a different position longitudinally of said shaft than the other of said projections;

a cam mounted for rotation with said shaft and including an outer surface received between said spring projections; said spring arms biasing said projections into engagement with said cam outer surface;

a plurality of recesses angularly spaced apart about said outer surface of said cam; said plurality of recesses being arranged in pairs positioned on substantially opposite angular sides of said cam outer surface; one of each pair of recesses being longitudinally aligned with one of said projections and the other of each pair of recesses being longitudinally aligned with the other of said projections; and said cam outer surface having no recess angularly opposite and longitudinally aligned with each of said recesses;

whereby a detent is provided at each rotary position of said shaft in which each recess of a pair of recesses is angularly aligned the projection with which that recess also is longitudinally aligned and no detent is provided at the angular position of said shaft substantially one hundred and eighty degrees removed therefrom.

6. A control as set forth in claim 5, wherein: an additional pair of recesses are provided in said outer surface of said cam, are positioned substantially 180 angular degrees apart and extend longitudinally of said shaft sufficiently to be longitudinally aligned with both of said projections, so that said cam may be easily mounted on or removed from said shaft by aligning said additional pair of recesses with said pair of projections.

7. A control as set forth in claim 5: each of said spring member arms includes an elongated bottom wall extending substantially parallel to said shaft and spaced apart lateral edge portions bent at substantially right angles to said bottom wall so that said arms are stiff substantially throughout their length while being pivotal at their junctions with said spring base.

8. A control as set forth in claim 5, further comprising; an operating knob mounted for rotation with said shaft to move said shaft between the multiplicity of its positions.

9. A control as set forth in claim 5, wherein: said spring member arms exert substantially balanced forces on said cam outer surface as said shaft is rotated between its plurality of positions.

* * * * *